US007360576B2

(12) United States Patent
Lin

(10) Patent No.: US 7,360,576 B2
(45) Date of Patent: Apr. 22, 2008

(54) ELECTRIC TRANSMISSION MODULE FOR MODULE FOR WINDOW CURTAINS HAVING WINDING WHEEL

(76) Inventor: Cheng Long Lin, 235 Chung - Ho Box 8-24, Taipei (TW)

( * ) Notice: Subject to any disclaimer, the term of this patent is extended or adjusted under 35 U.S.C. 154(b) by 731 days.

(21) Appl. No.: 10/831,484

(22) Filed: Apr. 26, 2004

(65) Prior Publication Data

US 2005/0239588 A1 Oct. 27, 2005

(51) Int. Cl.
*A47H 5/02* (2006.01)

(52) U.S. Cl. ..... 160/331; 160/168.1 P

(58) Field of Classification Search ..... 160/331, 160/168.1 P, 330, 321, 322, 265, 188, DIG. 17; 49/199

See application file for complete search history.

(56) References Cited

U.S. PATENT DOCUMENTS 977,500 A * 12/1910 Bailey ..... 472/78
1,027,027 A * 5/1912 Bailey ..... 472/78
4,031,944 A * 6/1977 Morrison et al. ..... 160/331
4,090,692 A * 5/1978 Jacobs ..... 472/78
4,481,998 A * 11/1984 Strandberg et al. ..... 160/344
4,548,250 A * 10/1985 Meharg et al. ..... 160/331
4,610,294 A * 9/1986 Anesi et al. ..... 160/331
4,852,627 A * 8/1989 Peterson et al. ..... 160/84.02
4,958,112 A * 9/1990 Zerillo ..... 318/280
4,995,442 A * 2/1991 Marzec ..... 160/331
5,791,580 A * 8/1998 Anderson et al. ..... 242/378.4
6,145,568 A * 11/2000 Lundstrom ..... 160/84.02
6,598,652 B1 * 7/2003 Montesinos Alonso ..... 160/331
2005/0252620 A1 * 11/2005 Lin ..... 160/168.1 P

* cited by examiner

*Primary Examiner*—David Purol

(57) ABSTRACT

An electric transmission module for window curtains having a winding wheel bridges a power unit and a window curtain set so that the opening/closure of the curtains can be controlled. A string of a set of transmission pieces is wound around a first wheel groove of the winding wheel, and another string of transmission pieces is wound around a second wheel groove of the winding wheel, whereby the forward or backward rotation of the motor urges a synchronic rotation in the winding wheel. The transmission pieces are respectively released at one wheel groove and drawn back at another wheel groove. Compared with the prior art, the transmission module is simple in structure and easy to install. It further improves the problem of sliding between a winding wheel and a transmission string.

3 Claims, 8 Drawing Sheets

ELECTRIC TRANSMISSION MODULE FOR MODULE FOR WINDOW CURTAINS HAVING WINDING WHEEL

FIELD OF THE INVENTION

The present invention relates to window curtains, and more particularly an electric transmission module for window curtains having a winding wheel powered by a two-way motor for controlling the opening/closure of the curtains. A winding wheel is used to bridge the motor the motor and a set of transmission pieces. The transmission pieces are engaged within lateral grooves of the winding wheel so that as the winding wheel rotates synchronically with the motor in a backward or a forward direction, the transmission pieces respectively undergo simultaneous releasing and drawing motions, driving the curtains to close or to open.

BACKGROUND OF THE INVENTION

The curtain control devices of the prior art utilize manual transmission modules having strings or bead chains for controlling the opening/closure of the curtains. As a more convenient control device, electric transmission module for the opening/closure of the curtains such as the one disclosed in FIG. 1, comprises a motor (not shown in the figure), an active wheel 61, button structures 62 and a box 63. A string (not shown in the figure) is wound around the lateral groove of the active wheel 61, and is pinched by a pair of passive wheels 64 on both sides of the active wheel 61. The motor drives the active wheel 61, which in turn drives the string for controlling opening/closure of the curtains. Restricted by the pinching force between the active wheel 61 and the passive wheels 64, sliding of the string with respect to the groove of the active wheel 61 often occurs, which hinders the electric transmission. Especially after using for an extended period of time, the surface of the string becomes so smooth that the transmission could be badly influenced.

Referring to FIG. 2, a motor is used to drive an active wheel 70. Passive wheels 72, 73, further guide a string 71 that passes around the active wheel 70, so that the two-way motor can control the opening/closure of the curtains. The prior art has the same disadvantages of the above first prior art.

SUMMARY OF THE INVENTION

The primary objective of the present invention is to provide an electric transmission module for window curtains having a winding wheel for bridging a power unit and a window curtain set so that the opening/closure of the curtains can be controlled. A string of a set of transmission pieces is wound around a first wheel groove of the winding wheel, and another string of transmission pieces is wound around a second wheel groove of the winding wheel, whereby the forward or backward rotation of the motor urges a synchronic rotation in the winding wheel. The transmission pieces are respectively released at one wheel groove and drawn back at another wheel groove. Compared with the prior art, the transmission module can alleviate the sliding between a transmission string and a winding wheel, making the transmission smoother.

The secondary objective of the present invention is to provide an electric transmission module for window curtains having a winding wheel whose functioning is less influenced by the weight due to its structural simplicity. And therefore the transmission module can be used with a variety of window curtains, regardless of their weights.

It is a further objective of the present invention that the transmission module is cheap to produce and more durable, due to its structural simplicity. Since all the parts are integrated in a single module, it is easy to install for a common user.

It is a further objective of the present invention that the motor can be controlled manually or by a remote control. Further, the motor can go in a forward or a backward direction so that the window curtains can be opened or closed.

The various objects and advantages of the present invention will be more readily understood from the following detailed description when read in conjunction with the appended drawings.

DETAILED DESCRIPTION OF THE PREFERRED EMBODIMENTS

Figure 1:
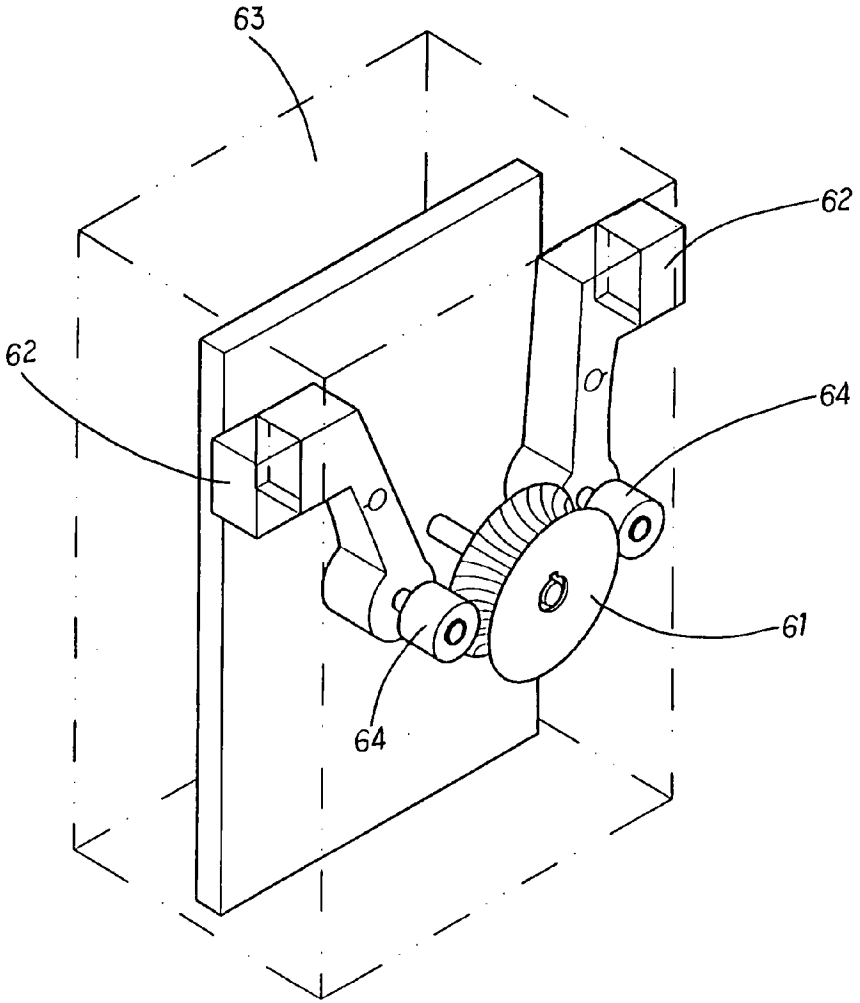
FIG. 1 PRIOR ART
FIG. 1 is a perspective view of the invention disclosed in one prior art.
Figure 2:
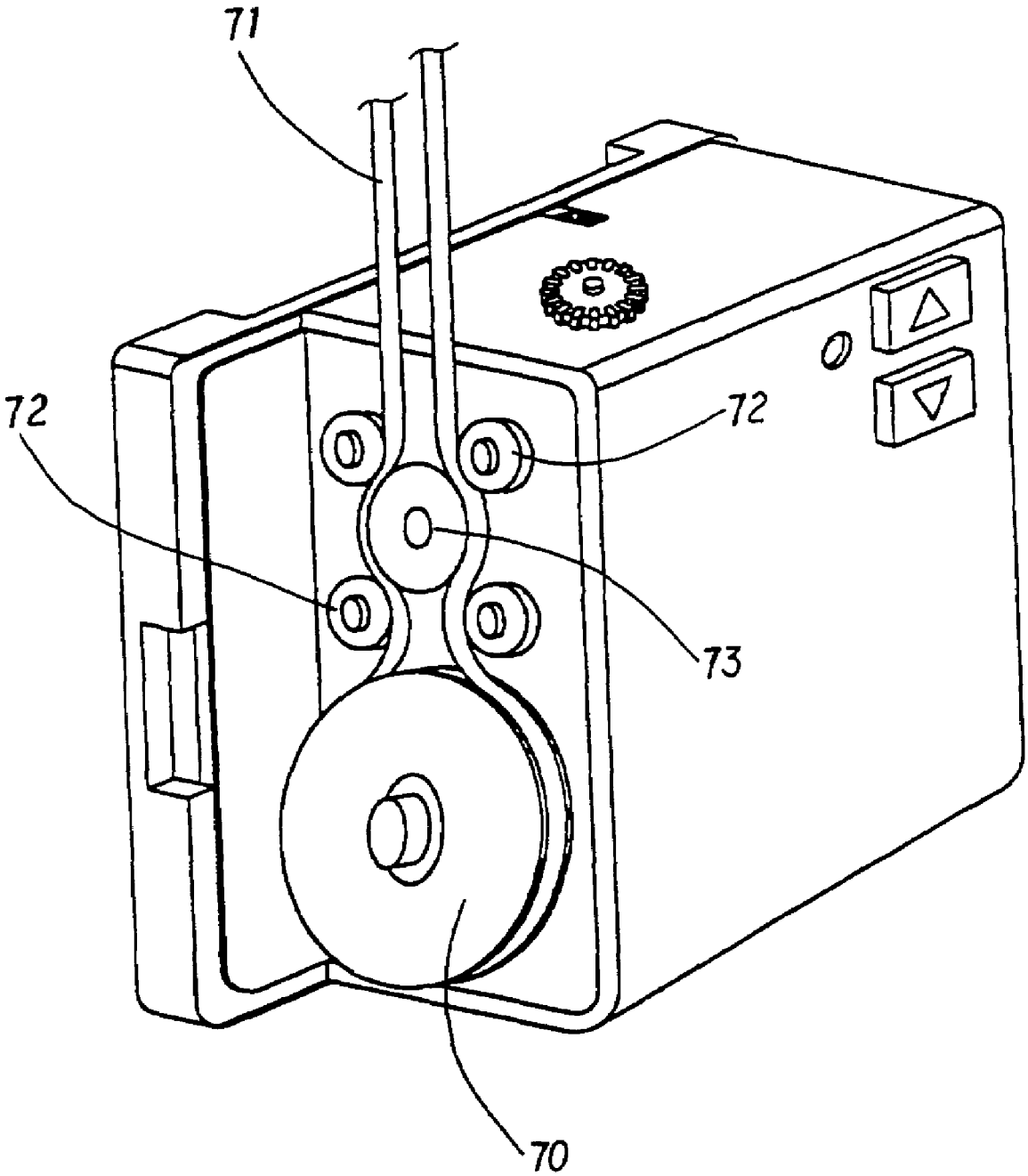
FIG. 2 PRIOR ART
FIG. 2 is a perspective view of the invention disclosed by another prior art.
Figure 3:
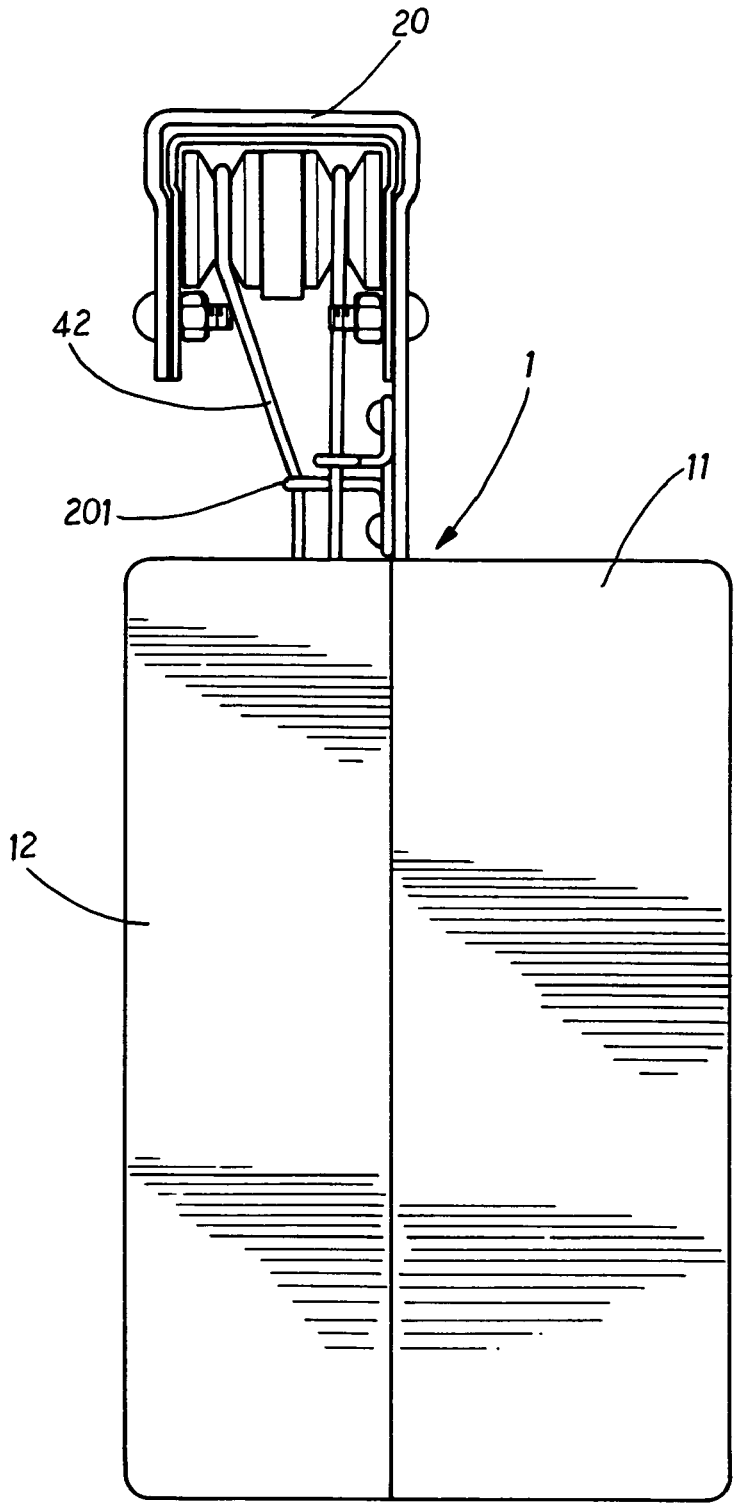
FIG. 3 is a lateral view of the present invention when installed at an end of a curtain rod.
Figure 4:
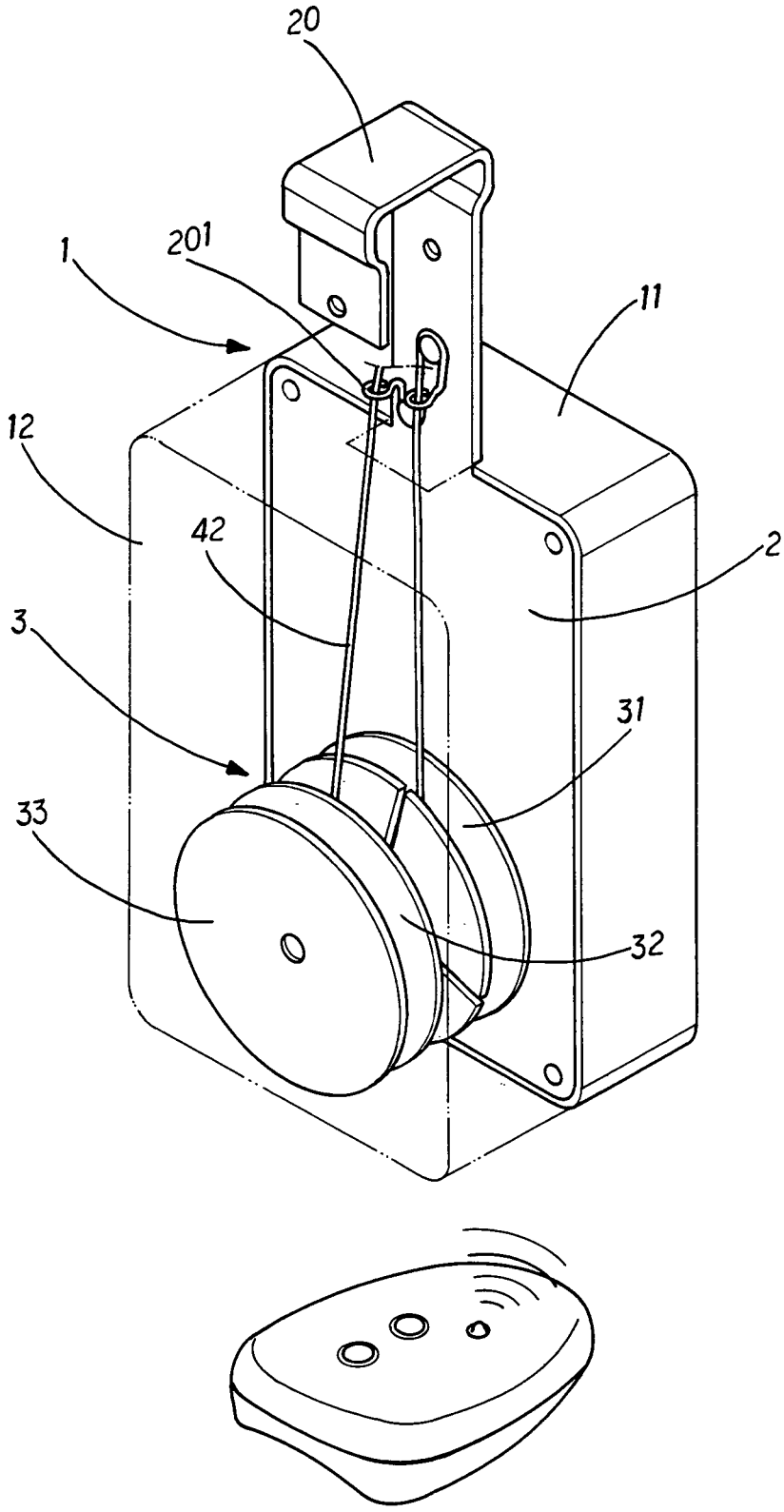
FIG. 4 is a perspective view of the present invention.
Figure 5:
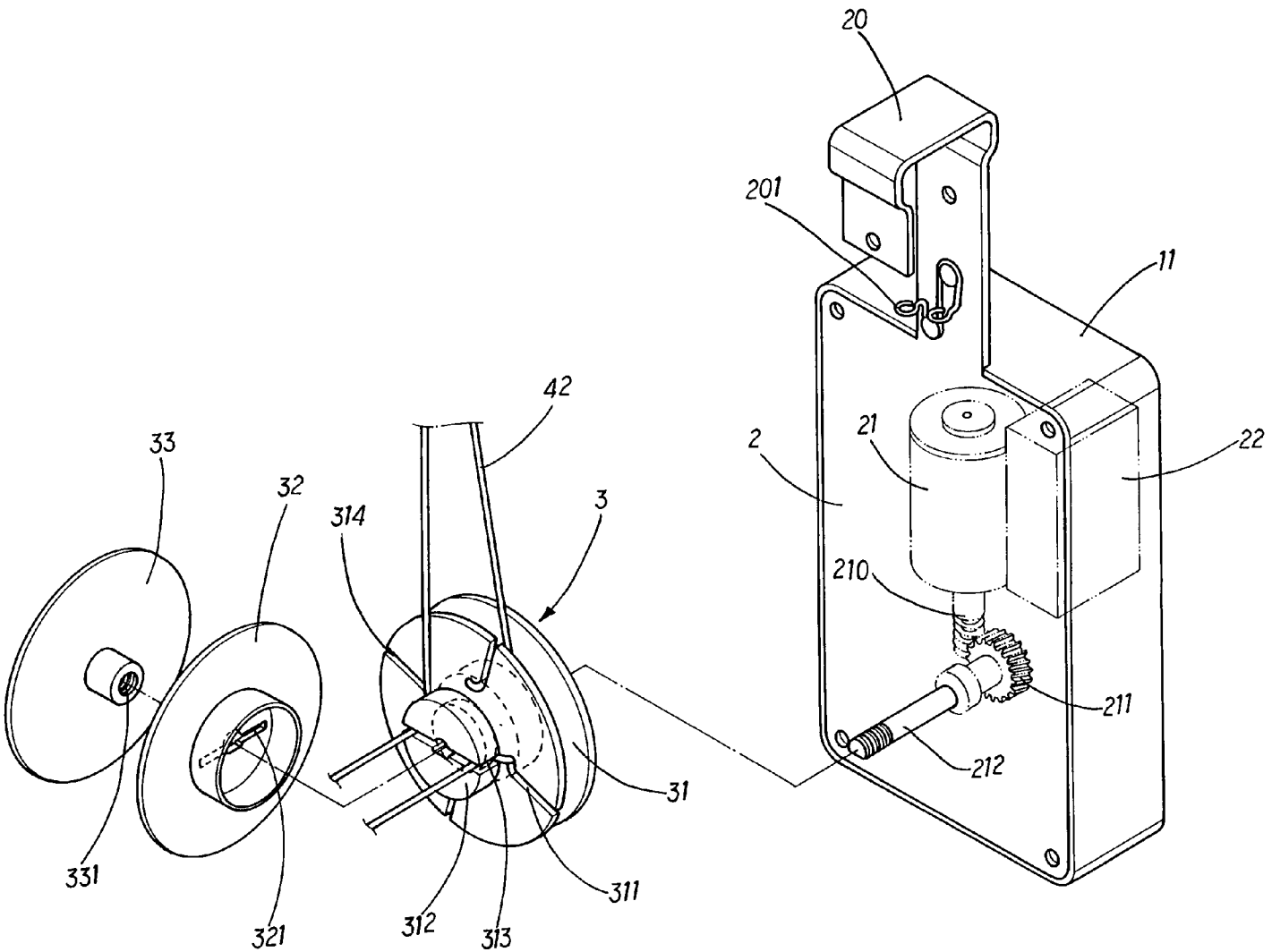
FIG. 5 is an exploded perspective view of the present invention.
Figure 6:
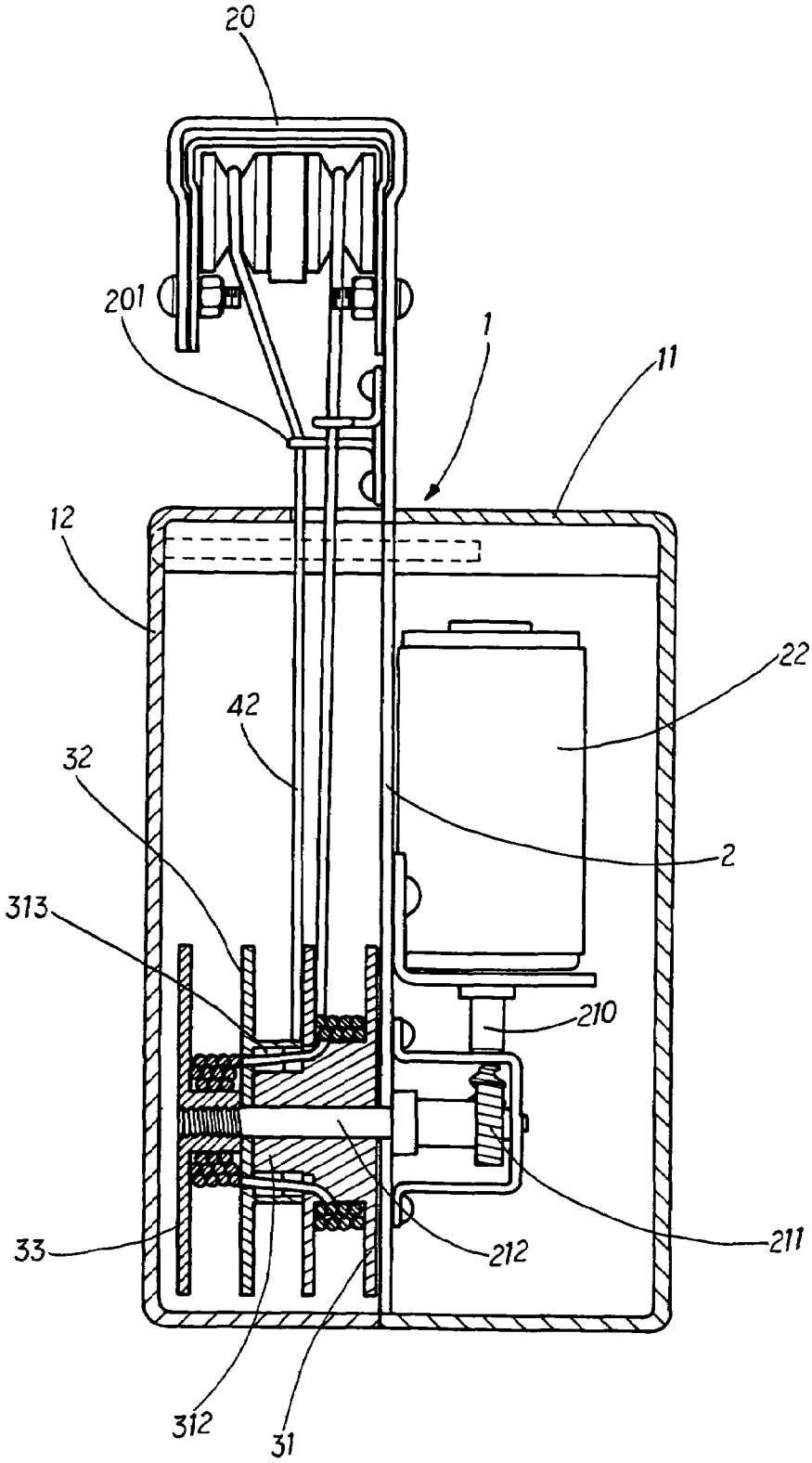
FIG. 6 is a lateral cross-sectional view of the present invention.
Figure 7:
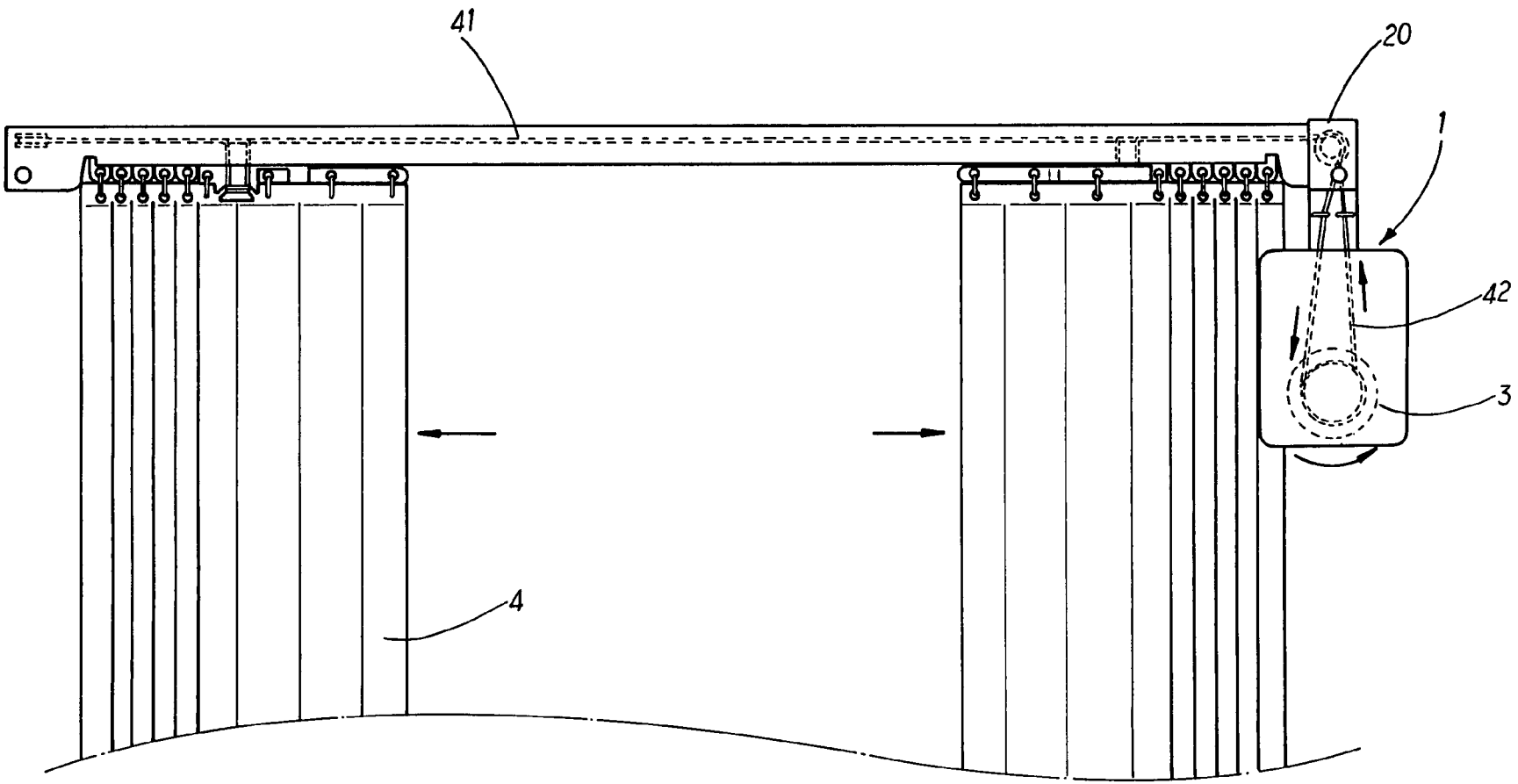
FIG. 7 illustrates the present invention being driven by a motor; the motor drives a winding wheel, and the winding wheel then drives transmission pieces so that window curtains are urged to open.
Figure 8:
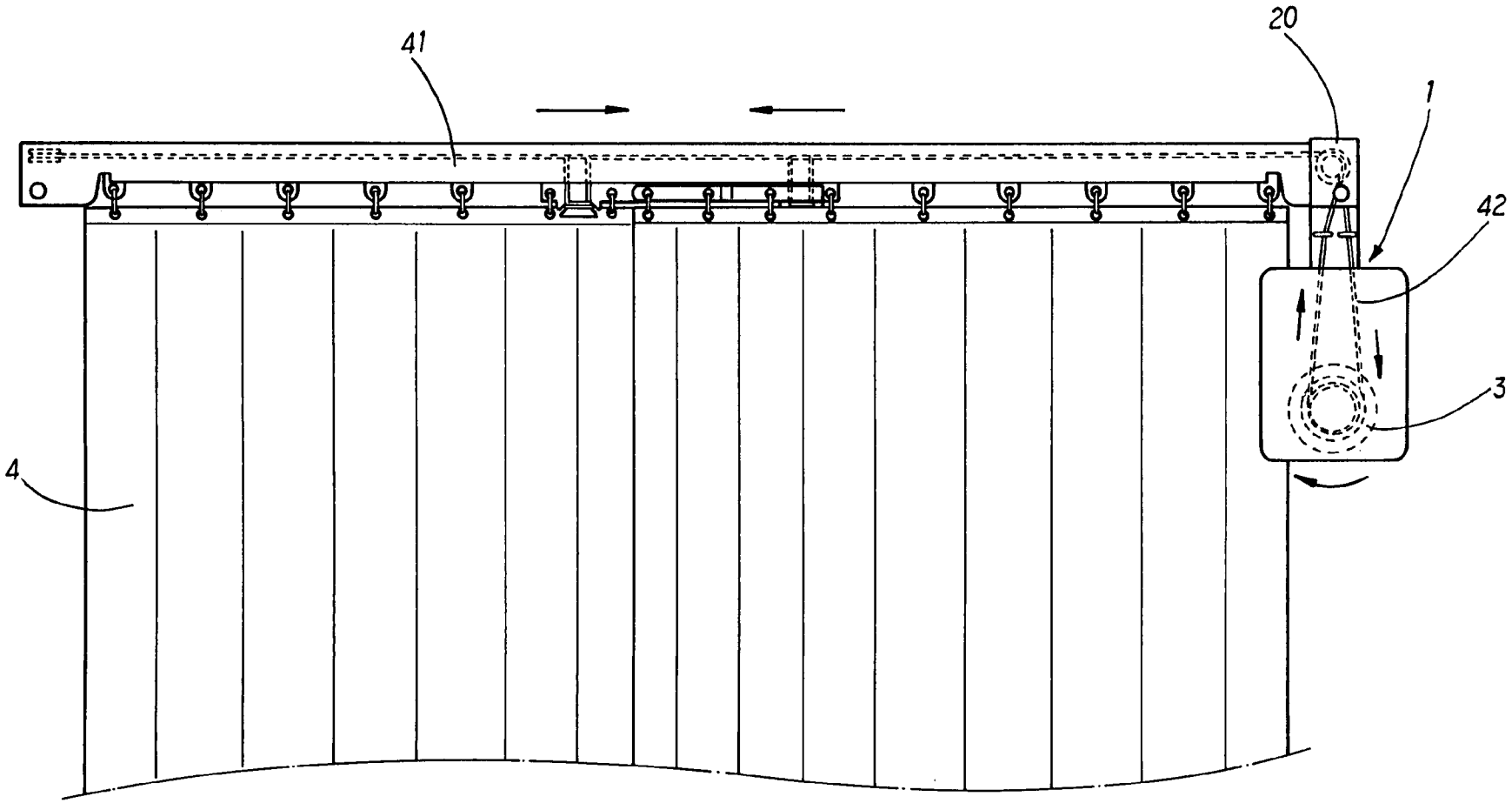
FIG. 8 illustrates the present invention being driven by a motor in a reverse direction; the motor drives a winding wheel, and the winding wheel then drives transmission pieces so that window curtains are urged to close.

Referring to FIG. 3 to 5, an electric transmission module having a winding wheel for window curtains according to the present invention comprises at least a box 1, a bracket 2 and a winding wheel 3. The box 1 further includes a base 11 and a cover 12, which can be mutually engaged. The bracket 2 and the winding wheel 3 are assembled and then put into the box 1. A hook portion 20 is extended from the topside of the bracket 2. As shown in FIG. 7, by securing the hook portion 20 at one end of the curtain rod 41 of a curtain set 4, a string of transmission pieces 42 can be guided through a guide hole 201 at the lower end of the hook portion 20. A motor 21 and a power and control unit 22 are disposed on the rear face of the bracket 2. The motor 21 drives a retarding gear wheel 211 through a shaft 210, and another output shaft 212 goes through the bracket 2 and drives the winding wheel 3. The winding wheel 3 is a wheel set having a plurality of grooves. The winding wheel 3 is mounted on the output shaft 212 so that the motor 21 can drive it, which then drives the transmission pieces 42 so as to control the opening/closure of the curtain set 4. A string of the transmission pieces 42 is guided through the guide hole 201 and is wound around a first wheel groove 31, as shown in FIGS. 5 and 6. Another string of the transmission pieces 42 is retained around a second wheel groove 32, so that the power and control unit 22 can activate a rotary of the motor 21 in a backward or a forward direction, urging the winding wheel 3 to rotate synchronically. The means of turning on the power and control unit 22 can be manual or remote-controlled. The rotation of the winding wheel 3 releases the string of the transmission pieces 42 in the first wheel groove 31, and draws back the string of the transmission pieces 42 in the second wheel groove 32. Or, in a reverse way, the winding wheel 3 draws back the string of the transmission pieces 42 in the first wheel groove 31, and releases the string of the transmission pieces 42 in the second wheel groove 32.

Referring to FIG. 5 to 7, to provide a convenient installing method for a user, the present invention can be easily secured at an end of a curtain rod 41. The string of the transmission pieces 42 that is guided through the guide hole 201 and wound around the first wheel groove 31 has its remained portion going through a lateral slot 311 of the winding wheel 3, extending along a radial slot 313 across a shaft column 312, and being guided through a hole 321 of the second wheel groove 32. Another string of the transmission pieces 42 is retained in a hole 314 on a lateral wall by the first wheel groove 31. The string extends along the radial slot 313 across the shaft column 312 and goes through a hole 321 by the second wheel groove 32. Since the second wheel groove 32 and shaft column 312 are coupled together, the string can be wound around the second wheel groove 32. A third wheel groove 33 is provided with an axial column 331 having a screwed hole that can be secured on the output shaft 212. The third wheel groove 33 can be attached to the second wheel groove 32, being the furthest member of the winding wheel 3 from the output shaft 212. The string of transmission pieces 42 extended from the hole 321 of the second wheel groove 32 can be wound around the third wheel groove 33. Thereby, the transmission pieces 42 are respectively engaged with the first wheel groove 31 and the second wheel groove 32. The forward or backward rotation of the motor 21 drives a synchronic rotation of the winding wheel 3, thereby urging the transmission pieces 42 to be respectively released and drawn back at the first wheel groove 31 and the second wheel groove 32. The forward or backward rotation of the motor 21 therefore controls the opening/closure of the window curtains.

The present invention is thus described, and it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. An electric transmission module for window curtains having a winding wheel, driven by an electric motor, comprising:

a winding wheel further including at least one first wheel and one second wheel, said first wheel and said second wheel being mounted along an output shaft of said electric motor coaxially and parallel to each other, said first wheel and said second wheel being each provided with a groove around the circumference thereof;

a plurality of transmission strings, one of said transmission strings being wound around said first groove of said first wheel, another of said transmission strings being wound around said second groove of said second wheel; and a bracket for mounting said electric motor and a transmission set;

whereby said electric motor rotates in a direction selected from a backward direction and a forward direction to urge a synchronic rotation in said winding wheel so that said transmission strings wound thereon are respectively released or drawn back at said first wheel and drawn back or released at said second wheel, causing a curtain set to open or to close; and.

2. The electric transmission module for window curtains having a winding wheel of claim 1 wherein said bracket is provided with a hook portion on a top face thereof, a lower side of said hook portion further including two holes for guiding said transmission strings.

3. The electric transmission module for window curtains having a winding wheel of claim 1 wherein an outer wall of said second wheel is attached with a third wheel, and wherein said transmission string extended from said second wheel is wound around said third wheel.

* * * * *